US006955493B2

(12) United States Patent
Acquaviva et al.

(10) Patent No.: US 6,955,493 B2
(45) Date of Patent: Oct. 18, 2005

(54) FLEXIBIND BOOKS

(75) Inventors: Thomas Acquaviva, Penfield, NY (US); Thomas N. Taylor, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 26 days.

(21) Appl. No.: 10/338,961

(22) Filed: Jan. 8, 2003

(65) Prior Publication Data

US 2004/0131446 A1 Jul. 8, 2004

(51) Int. Cl.[7] ..... B42D 1/00

(52) U.S. Cl. ..... 402/8; 24/67 R; 24/67 P; 24/67.1; 24/67.9; 281/15.1; 281/21.1; 281/27.1; 281/28; 412/6; 412/33; 412/43; 402/13; 402/25; 402/58; 402/59; 402/64; 402/500

(58) Field of Search ..... 402/8, 13, 25, 402/58, 59, 64, 500, 7; 412/43, 6, 33; 281/15.1, 281/21.1, 28, 27.1; 24/67 R, 67.9, 67 P, 67.1

(56) References Cited

U.S. PATENT DOCUMENTS

| | | | | | |
|---|---|---|---|---|---|
| 396,088 | A | * | 1/1889 | Hosford | 412/6 |
| 451,710 | A | * | 5/1891 | Grunzweig | 402/19 |
| 474,509 | A | * | 5/1892 | Wagler | 139/426 R |
| 549,080 | A | * | 10/1895 | Schonenberger | 402/8 |
| 708,102 | A | * | 9/1902 | Waldo | 402/48 |
| 877,478 | A | * | 1/1908 | Barnard | 402/13 |
| 1,142,021 | A | * | 6/1915 | Chambers | 402/13 |
| 1,526,533 | A | * | 2/1925 | Prosper | 281/23 |
| 1,630,487 | A | * | 5/1927 | Harrison | 402/8 |
| 3,467,479 | A | * | 9/1969 | Holes et al. | 402/13 |
| 3,485,564 | A | * | 12/1969 | Holes et al. | 402/13 |
| 3,608,115 | A | * | 9/1971 | Chou et al. | 412/19 |
| 4,369,013 | A | | 1/1983 | Abildgaard et al. | |
| 4,674,906 | A | | 6/1987 | Abildgaard | |
| 4,681,473 | A | * | 7/1987 | Jakob | 402/15 |
| 4,714,366 | A | * | 12/1987 | Boudrot | 402/13 |
| 5,620,206 | A | * | 4/1997 | Flores | 281/21.1 |
| 6,409,447 | B2 | * | 6/2002 | Malmros | 412/40 |

FOREIGN PATENT DOCUMENTS

| | | | | |
|---|---|---|---|---|
| GB | 4599 | * | 8/1912 | |
| JP | 2004209987 A | * | 7/2004 | B42F 13/12 |

* cited by examiner

*Primary Examiner*—Derris H. Banks
*Assistant Examiner*—Mark Henderson
(74) *Attorney, Agent, or Firm*—William A. Henry

(57) ABSTRACT

A system for binding books includes a flexible binding material in the form of a stud having top and bottom caps. The stud is inserted into signature staples that protrude from the body of the signature to form stud holes. The binding material can be any material that is extremely flexible, including silicone, metals, etc., as long as it allows the signatures to open in a lay-flat manner either at the signature interfaces or in the body of any signature. The flexible binding material can also be used to temporarily bind pre-punched pages of a book by inserting the flexible binding material into the pre-punched holes to facilitate lay-flat opening of the book.

10 Claims, 4 Drawing Sheets

FLEXIBIND BOOKS

BACKGROUND OF THE INVENTION

1. Field of the Invention

This invention relates generally to binding of books and, in particular, to a new and improved binding for loose pages, signatures and books.

2. Description of Related Art

Various means have been used in the past to bind books. One commonly used method is to sew the signature sheets together using sewing machines of various types. Such a method is inherently slow and expensive. Another method has been the gluing of the spine ends of the sheets together, preferably to a tape. One disadvantage of such methods is the fact that it requires time for the glue to set and further that the binding is weak. A still further method has been stapling the sheets together with metal staples. Rigid metal posts have been used in such books as accounting books, but these have been very heavy and expensive for loose-leaf purposes.

Attempts at improving bookbinding have been made over the heretofore-mentioned devices and methods. For example, bookbinding is provided in U.S. Pat. No. 4,369,013 issued Jan. 18, 1983 to William H. Abildgaard et al. by plastic studs which fit through holes vicinal one margin of each sheet and strips which are fixed to the ends of the studs. The studs may be formed in the matching strip or strips to receive the stud ends. Excess stud lengths are sheared and headed to lock the strips and interposed sheet in position.

In U.S. Pat. No. 4,674,906 to William H. Abildgaard, issued Jan. 23, 1987 a pair of strips are used for binding with one of the strips having longitudinally spaced flexible plastic studs and the other having holes complementary to the spacing of the studs adjacent one or more grooves into which the bent over studs may be inserted, and also provided with retaining means for holding the studs in bent over position.

Some hot melt finishing devices do a good job of holding pages together to produce a professionally appearing book. However, because of the relatively inflexible nature of the adhesive and adhesive finding it's way between individual sheets, the bound book does not lay flat when opened. The pages tend to close upon themselves to produce a large bend at the spine. Customer surveys indicate that they would like lay-flat binding at a low cost similar to the GBC "Cerloc," spiral wire bind, or dual bind. These binding devices penetrate holes in the paper in order to enable the lay-flat feature. They also require pre-punching the individual sheets with a particular hole pattern, or punching un-punched paper on-line. Pre-punched paper is expensive and on-line punching creates paper dust, hole fragments, and noise. In addition, the binding material, whether it is a plastic comb, plastic spiral wire, single or dual wire, is expensive. A staple is very inexpensive, but it does not produce a lay-flat book.

Hence, there is still a need for a binding system that can produce thick, bound, lay-flat books that are inexpensive and may or may not use pre-punched sheets.

SUMMARY OF THE INVENTION

Accordingly, pursuant to the features of the present invention, an improved system is disclosed for forming a book from multiple stapled signatures that are subsequently bound together in a novel manner. The system includes a Flexibind material used to bind edges of the stapled signatures. The Flexibind material is a low durometer stretchable material, such as, silicone rubber and has a bottom and a top cap.

Booklets are saddle-stitched, leaving some space between a staple attached to one margin of the signatures. The staple ends are snug against the inside of the signatures. A space left between the staple and the outside margin of the signatures leaves room for the Flexibind material. Several of these booklets are saddle-stitched and folded in half, and then they are bound together with strips of the Flexibind material. The whole collection can then be wrapper by a cover.

Alternatively, a temporary binding system is disclosed that includes a flexible binding material inserted into holes of pre-punched pages of a book. The flexible binding material can be silicone rubber with caps on top and bottom to prevent accidental removal. This is a low cost alternative to paper clips and spring clip type devices, which enables the lay-flat binding feature.

These and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
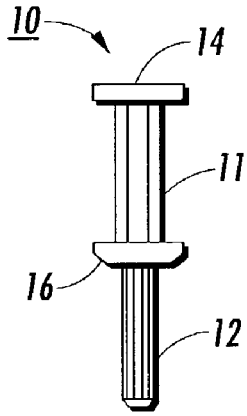
FIG. 1 is a front view of an embodiment of a stud made of the flexible binding material of the present invention and used to bind signatures or pages of a book.

For a general understanding of the features of the present invention, reference is made to the drawings. In the drawings, like reference numerals have been used throughout to identify identical elements. FIG. 1 schematically depicts a front view illustrating a flexible binding material used to bind several signatures or pre-punched pages incorporating the features of the present invention therein. It will become evident from the following discussion that the flexible stud of the present invention may be employed in a wide variety of applications and is not specifically limited in its application to the particular binding system and method specifically mentioned herein.

Figure 2:
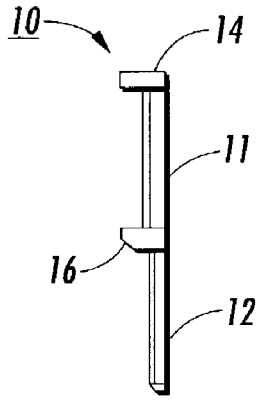
FIG. 2 is an elevation view of the flexible stud of FIG. 1.
Figure 3:
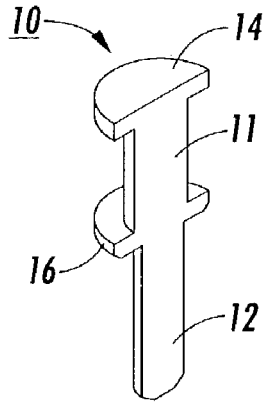
FIG. 3 is a perspective view of the flexible stud of FIG. 1.

Referring now to FIGS. 1–3, various views are shown illustrating a Flexibind stud that is used in accordance with the present invention to bind several signatures into a bound book or to bind several pre-punched pages into a book. The Flexibind stud is a strong, low durometer stretchable material, such as silicone rubber, and has a bottom and a top cap. It should be understood that any flexible material could be used as the binding material as long as it is flexible and low in cost. In FIGS. 1–3, a stud 10 is shown that can be used to temporarily hold loose pages of a book together. For example, when printing and distributing pages for later insertion into ring binders, such as, updates to manuals or teaching materials, for producing printed books with a short life, such as, weekly inventories, etc. Flexibind stud 10 includes shaft portions 11 and 12 with shaft portion 11 extending between top cap 14 and bottom cap 16 and shaft portion 12 extending below bottom cap 16. Flexibind stud 10 consists of a strong, low durometer 40 SA material, such as silicone rubber, and shaped as a semi-round post. The post could be round, or any other shape, if desired.

Figure 4:
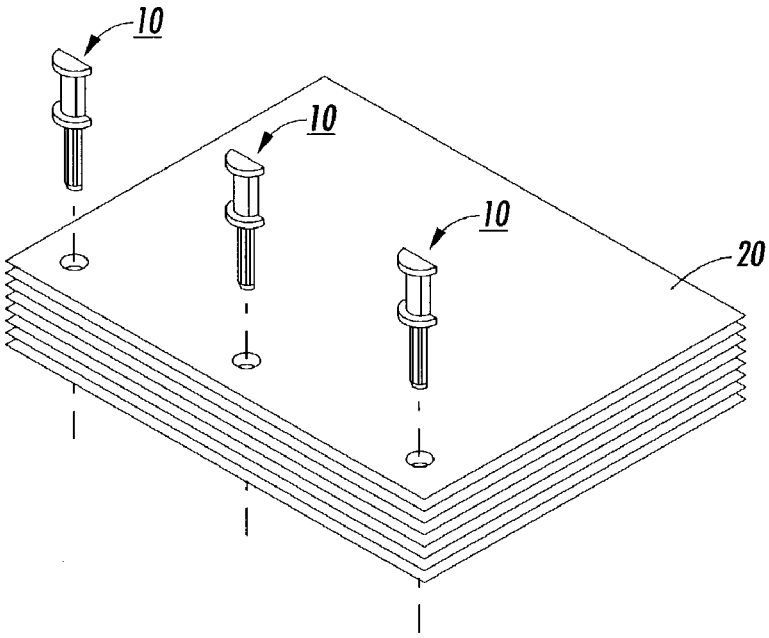
FIG. 4 is an exploded perspective view of the flexible studs in position to bind pages of a book once inserted into pre-punched holes in the pages of the book.
Figure 5:
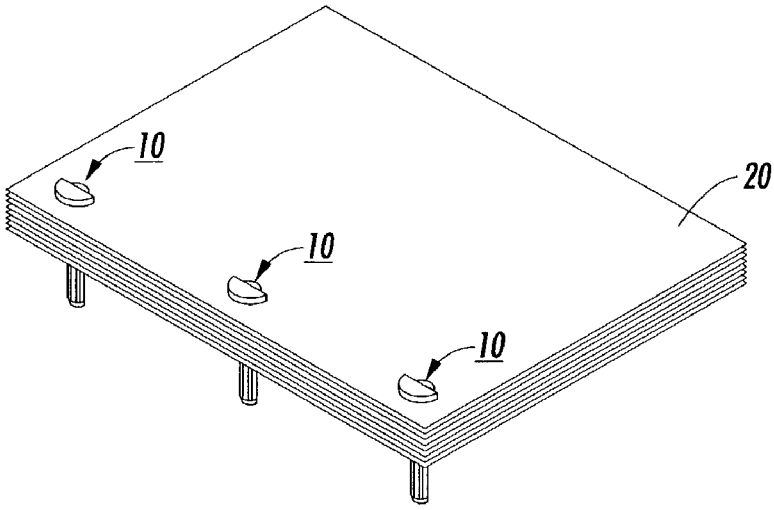
FIG. 5 is a perspective view of the flexible studs inserted into pre-punched holes in the pages of the book.

As shown in FIGS. 4 and 5, a compiled set of pre-punched pages 20 are manually jogged and Flexibind stud 10 is pushed through the top hole of the pages and pulled through the bottom hole until cap 14 rests on top of the pages and cap 16 rests on the bottom of the pages. The Flexibind caps 14 and 16 on opposite ends of stud 10 prevent the book of pages from coming apart when it is opened. Shaft portion 12 of stud 10 is used to manually pull the stud through the pre-punched holes in the pages and may be cut off to present a smooth outer surface of bottom cap 16. Alternatively, the flexible shaft can be left intact, and when the Flexbind is manually removed from the book, it can be reused with no tools, in the same manner as a paper clip can be reused. As seen in FIG. 5, cap 14 is semi-circular in configuration and, as such, facilitates lay-flat viewing of signatures as they are opened.

Figure 6:
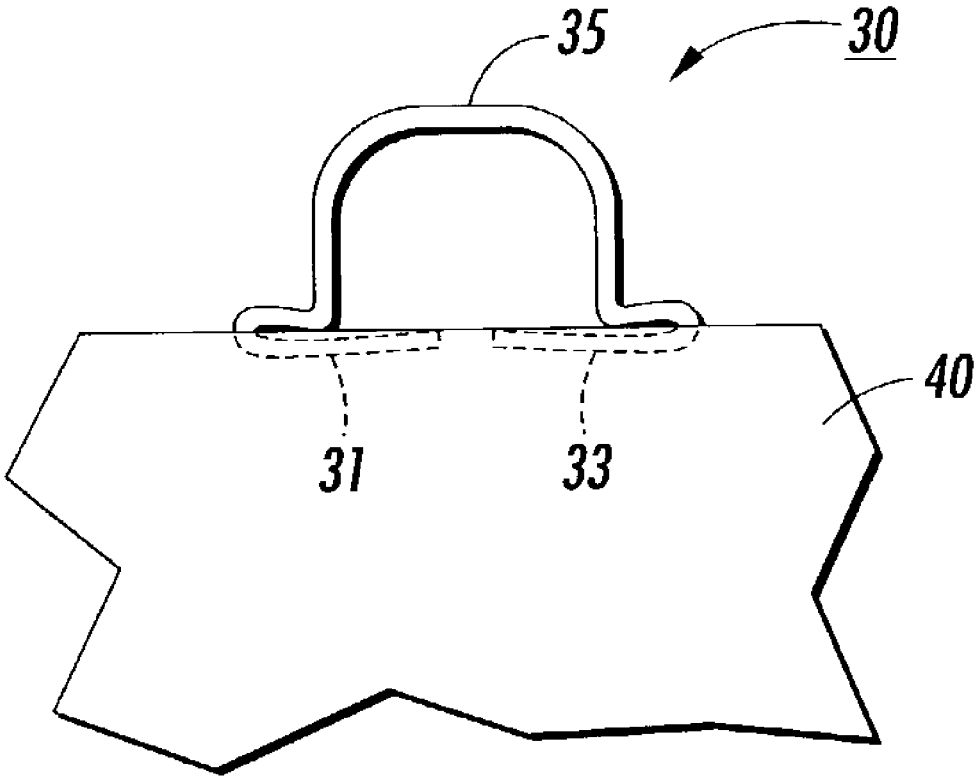
FIG. 6 is a plan view of a staple attached to the binding end of a signature page.
Figure 7:
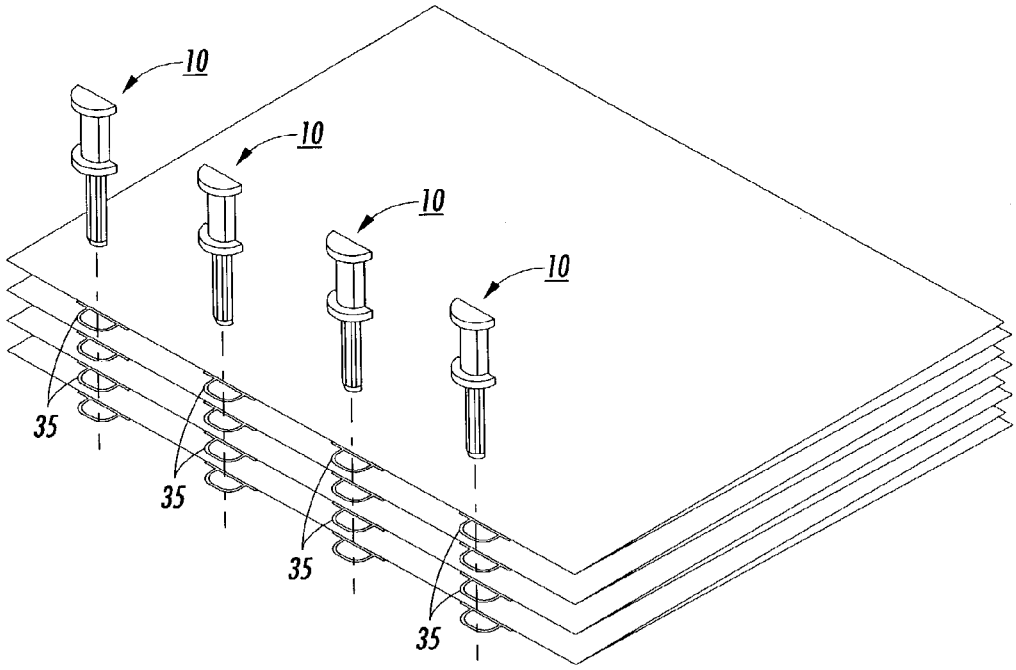
FIG. 7 is an exploded perspective and plan view of a series of stapled signatures with flexible studs projected thereabove.

In FIG. 6, and in accordance with another embodiment of the present invention, a staple 30 is shown attached to the binding edge of a signature 40. The signature is created in a conventional manner, i.e.; it is printed, compiled, stapled, folded, and presented to a binding station. One of the unique features of the present invention is the use of staples 30 that include a crown portion 35 and leg members 31 and 33 with the crown portion 35 of the staple protruding from the binding edge of the signature about 4 mm. Three or more staples can be inserted into each signature as shown in FIG. 7. The purpose of crown 35 of staple 30 is to create a "hole" outside the body of the signature into which Flexibind stud 10 is inserted. The exact shape of the "hole" is not critical. While FIG. 6 shows one hole configuration, it should be understood that the hole may also be configured as rectangular, circular, oblong, etc.

Figure 8:
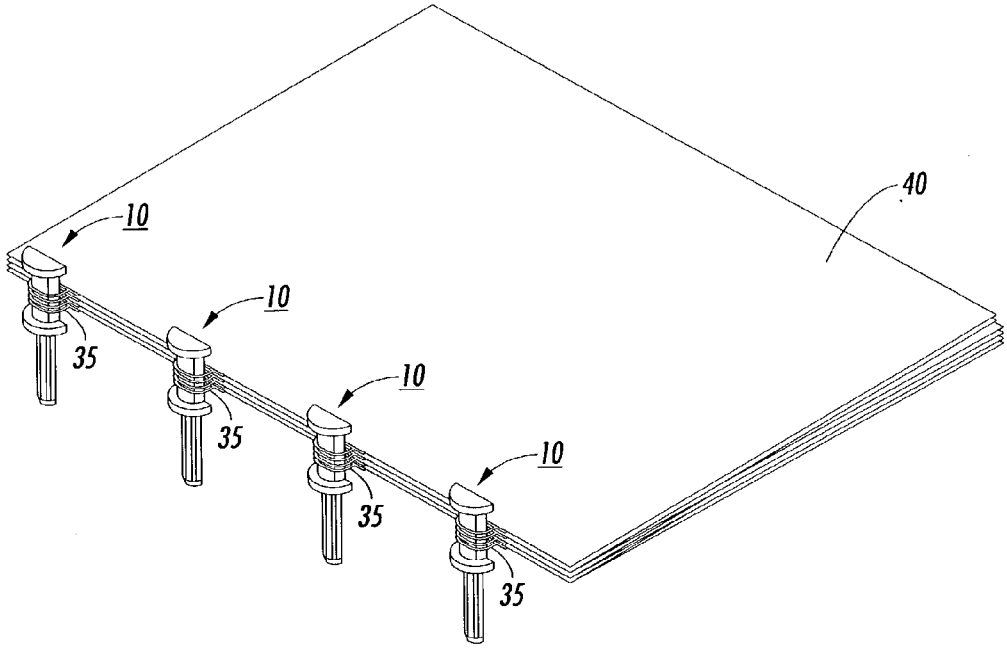
FIG. 8 is a perspective view of the signatures of FIG. 7 bound together by flexible studs extending through holes in staples attached to the binding edges of the signatures.

As shown in FIG. 8, stapled signatures are registered with all of the corresponding staples aligned one above another. A Flexibind stud 10 is inserted into the gap between each staple and the edge of the signature as shown. In this manner, all of the signatures are held together along the bind edge. When opening the Flexibind book, each page of any signature can be opened 180° and will lay flat. When the last page of a signature is opened, it also lays flat because the binding is extremely flexible, but there is a small gap between signatures, just as would appear in conventional spiral or dual wire bind. The flexible nature of the Flexibind and the fact that the bind does not go through the sheet itself, enables lay flat binding. Since the Flexbind material can stretch almost 2×, only two post sizes are necessary for books from 0.5 inches to 2" thick. Any number of apparatus for supplying the Flexbind material and for automatic insertion of the Flexbind material into the stapled signatures can be envisioned and, thus, are not described herein.

It should now be understood that a simple, low cost, flexible binding material has been disclosed that is inserted into either holes in pre-punched pages or into holes formed in staples attached to the binding edges of signatures in order to accommodate lay-flat booklets. Flexibind binding has several key advantages over hole punching and the standard glue binding strips including: 1) booklets can be "subwayed" or folded 360°; 2) booklets lay flat when opened; 3) there is no paper debris from punched holes; and 4) the Flexbind method of binding utilizes standard staples.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A device for binding the edges of signatures having top and bottom signatures in books, comprising:

a flexible, single piece member, said single piece member including a stem having flat surfaces extending orthogonally therefrom at separate locations that rest on said top and bottom signatures to secure the signatures between said top and bottom signatures and accompany the signatures during use thereof; and at least one staple attached to a binding edge of the signatures and thereby leaving a crown portion thereof presenting a hole for insertion of said flexible, single piece member to accomplish lay-flat opening of the signatures, and wherein said flat surfaces are of greater width than said crown portion of said at least one staple.

2. The device of claim 1, wherein said flexible, single piece member is made of silicone rubber or similar material.

3. The device of claim 1, wherein the signatures are saddle-stitched.

4. The device of claim 1, wherein said stem of said at least one flexible, single piece member is reusable without the use of tools and has a flat surface thereof positioned adjacent to the binding edge of the signatures in order to facilitate lay-flat opening of the signatures.

5. The device of claim 2, wherein said flat surfaces of said flexible, single piece member includes a top cap portion and a bottom cap portion, and wherein said flat surfaces change shape as said flexible, single piece member is pulled through said crown portion of said at least one staple with said top cap portion resting on said top signature and said bottom cap portion resting against said bottom signature.

6. The device of claim 5, wherein said flexible, single piece member includes a portion thereof extending beyond one of said flat surfaces that is to be grasped in order to pull said at least one flexible, single piece member upwardly through said crown portion of said at least one staple.

7. The device of claim 5, including a plurality of flexible, single piece members and staples attached to the signatures.

8. A method for binding the edges of signatures of books having a top signature and a bottom signature, comprising:

providing a flexible, single piece member, said single piece member including a stem having flat surfaces extending orthogonally at separate locations from a flat side thereof and rest on said top and bottom signatures to secure the signatures between said top and bottom signatures and accompany the signatures during use thereof;

providing at least one staple attached to a binding edge of signatures and leaving a crown portion thereof presenting a hole for insertion of said flexible, single piece member to accomplish lay-flat opening of the signatures; and inserting said at least one flexible member into said crown portion of said at least one staple to thereby bind the signatures, and wherein said flat surfaces are of greater width than said crown portion of said at least one staple.

9. The method of claim 8, including positioning said flat side of said stem adjacent said binding edge of the signatures.

10. A method for binding the edges of signatures of books, comprising:

providing at least one flexible, single piece member, said single piece member including a stem having flat surfaces extending orthogonally from a flat side thereof that are adapted to secure the signatures therebetween;

providing at least one staple, said at least one staple being adapted for attachment to a binding edge of signatures and leaving a crown portion thereof presenting a hole for insertion of said flexible, single piece member to accomplish lay-flat opening of the signatures;

inserting said at least one flexible member into said crown portion of said at least one staple to thereby bind the signatures, and making said flexible, single piece member of silicone rubber.

* * * * *